US008457533B2

(12) United States Patent
Sakamoto et al.

(10) Patent No.: US 8,457,533 B2
(45) Date of Patent: Jun. 4, 2013

(54) DEVELOPING DEVICE AND IMAGE FORMING APPARATUS

(75) Inventors: Takashi Sakamoto, Kanagawa (JP); Hiroaki Ohkuma, Kanagawa (JP); Daisuke Nakai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 251 days.

(21) Appl. No.: 12/775,893

(22) Filed: May 7, 2010

(65) Prior Publication Data

US 2011/0013943 A1 Jan. 20, 2011

(30) Foreign Application Priority Data

Jul. 15, 2009 (JP) ..... 2009-167182

(51) Int. Cl.
*G03G 15/08* (2006.01)

(52) U.S. Cl.
USPC ..... 399/256

(58) Field of Classification Search
USPC ..... 399/254, 256
See application file for complete search history.

(56) References Cited

U.S. PATENT DOCUMENTS 6,266,504 B1 * 7/2001 Katoh ..... 399/256

FOREIGN PATENT DOCUMENTS

| | | |
|---|---|---|
| JP | A-11-024382 | 1/1999 |
| JP | A 2001-249527 | 9/2001 |
| JP | A 2004-151354 | 5/2004 |
| JP | A 2009-098269 | 5/2009 |

OTHER PUBLICATIONS

Office Action dated Feb. 12, 2013 issued in Japanese Patent Application No. 2013-003593 (with translation).

* cited by examiner

*Primary Examiner* — David Gray
*Assistant Examiner* — Gregory H Curran
(74) *Attorney, Agent, or Firm* — Oliff & Berridge, PLC

(57) ABSTRACT

A developing device includes a first chamber, a second chamber, a first inlet portion, a first carrying member and an auxiliary blade. The first chamber receives a developer supplied to a developer holder. The second chamber receives the developer carried from the first chamber after being circulated between the first chamber and the second chamber. The first inlet portion allows the developer to be introduced from the second chamber to the first chamber. The first carrying member is disposed in the first chamber to carry the developer in the first chamber in a first carrying direction. The first carrying member includes a rotating shaft, a spiral blade provided at an outer periphery of the rotating shaft, and the auxiliary blade formed toward an upstream side of the first carrying direction from the spiral blade.

17 Claims, 8 Drawing Sheets

DEVELOPING DEVICE AND IMAGE FORMING APPARATUS

CROSS-REFERENCE TO RELATED APPLICATION

This application is based on and claims priority under 35 USC 119 from Japanese Patent Application No. 2009-167182 filed on Jul. 15, 2009.

BACKGROUND

Technical Field

The present invention relates to a developing device and an image forming apparatus.

SUMMARY

According to an aspect of the invention, a developing device includes a developer holder, a first chamber, a second chamber, a first inlet portion, a second inlet portion, a first carrying member and a second carrying member. The developer holder rotates while the developer holder holds developers on a surface of the developer holder. The first chamber contains the developers supplied to the developer holder. The second chamber contains the developers carried from the first chamber after the developers are circulated between the first chamber and the second chamber. The first inlet portion connects the first chamber and the second chamber. At least a part of the first inlet portion overlapping a developer-holding portion of the developer holder. The second inlet portion connects the first chamber and the second chamber. The first carrying member is disposed in the first chamber, and carries the developers in the first chamber in a first carrying direction directed toward the second inlet portion. The second carrying member is disposed in the second chamber, and carries the developers in the second chamber in a second carrying direction directed toward the first inlet portion. The first carrying member includes (i) a rotating shaft, (ii) a spiral blade provided at an outer periphery of the rotating shaft, and (iii) an auxiliary blade formed toward an upstream side of the first carrying direction from the spiral blade wall. A gap is formed between an upstream end of the auxiliary blade and the spiral blade and the spiral blade wall in the first carrying direction.

BRIEF DESCRIPTION OF THE DRAWINGS

Exemplary embodiments of the invention will be described in detail based on the following figures, wherein:

FIGS. 3A to 3C are diagrams illustrating the whole of a developing device according to a first embodiment of the present invention, in which FIG. 3A is a sectional perspective view illustrating main elements when a developing container cover is removed, FIG. 3B is a diagram illustrating a supply auger, and FIG. 3C is a diagram illustrating a stirring auger;

FIGS. 6A to 6C are diagrams illustrating an upstream end portion of a supply auger according to a first embodiment, in which FIG. 6A is an enlarged view illustrating main elements of the supply auger, FIG. 6B is a diagram illustrating the carrying of developers by a blade, and FIG. 6C is a diagram illustrating the amount of developers interposed between blades;

FIGS. 8A to 8D are diagrams illustrating a conventional developer carrying member, in which FIG. 8A is a diagram illustrating the configuration in which no gap is formed in the developer carrying member, FIG. 8B is a diagram illustrating the state in which the state shown in FIG. 8A is rotated by 90°, FIG. 8C is a diagram illustrating the configuration in which a phase is not synchronized, and FIG. 8D is a diagram illustrating a state in which the state shown in FIG. 8C is rotated by 90°.

DETAILED DESCRIPTION

Figure 1:
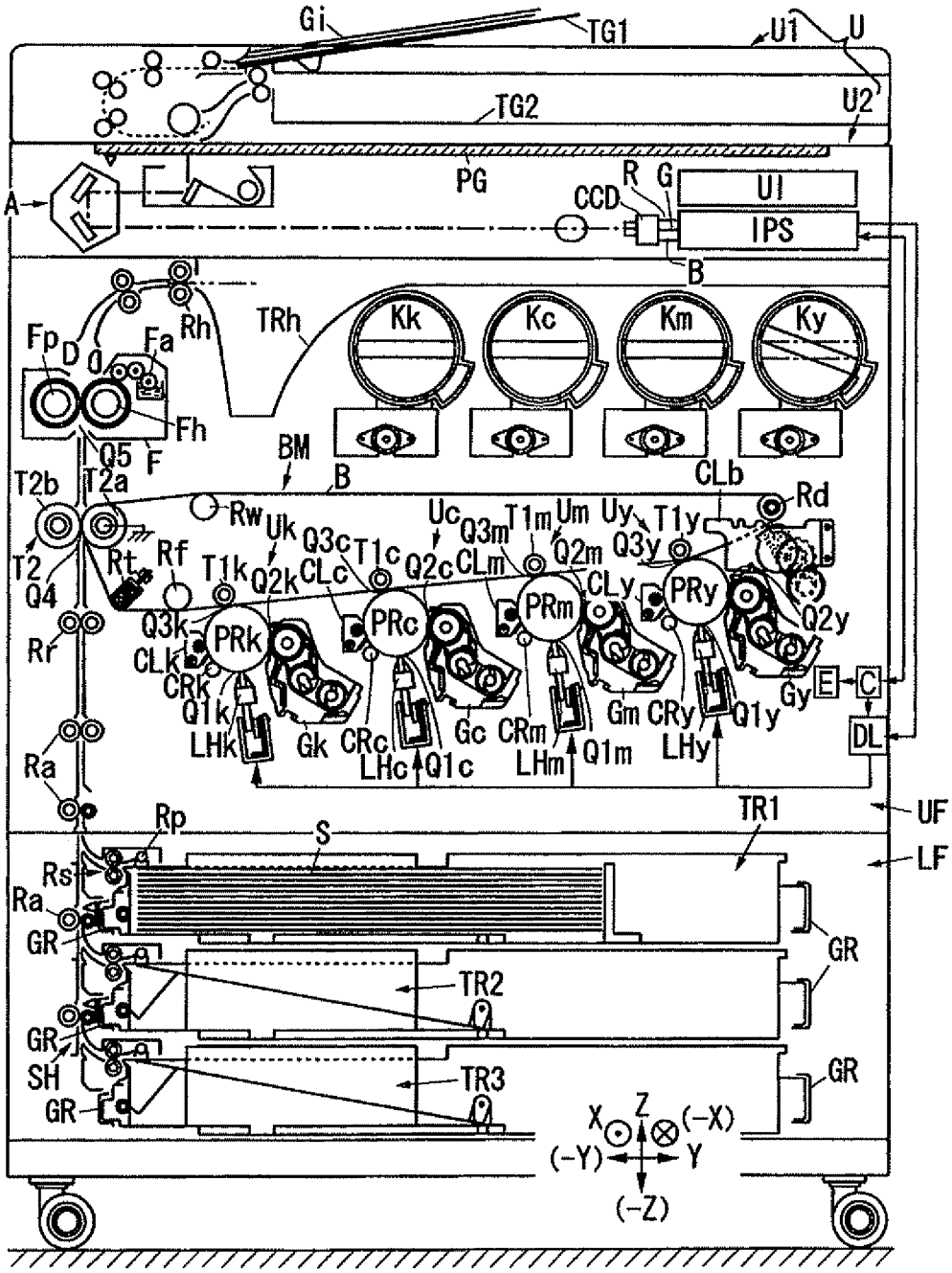
FIG. 1 is a diagram illustrating the whole of an image forming apparatus according to a first embodiment of the present invention.

Hereinafter, an embodiment of the present invention will be described in detail with reference to the accompanying drawings. However, the present invention is not limited to the embodiment below.

To facilitate the understanding of the following description, in the drawings, a front and rear direction will be referred to as an X axis direction, a right and left direction will be referred to as a Y axis direction, and an upper and lower direction will be referred to as a Z axis direction. Further, a direction or a side indicated by arrows X, −X, Y, −Y, Z and −Z will be referred to as the front, the rear, the right, the left, the upward and the downward, or the front side, the rear side, the right side, the left side, the upper side and the lower side, respectively.

In addition, in the drawings, the symbol obtained by inserting [•] into [O] means an arrow toward the surface from the back of a paper and the symbol obtained by inserting [x] into [O] means an arrow toward the back from the surface of the paper.

Moreover, in the description using the accompanying drawings, members other than members necessary for helping the understanding of the description will be appropriately omitted.

FIG. 1 is a diagram illustrating the whole of an image forming apparatus according to a first embodiment of the present invention.

In FIG. 1, a copy machine U as one example of the image forming apparatus includes an automatic original document carrying apparatus U1, and an apparatus body U2 that supports the automatic original document carrying apparatus U1 and is provided at the upper end thereof with a transparent original document reading surface PG.

The automatic original document carrying apparatus U1 includes an original document feeding unit TG1, which receives a plurality of piled original documents Gi to be copied, and an original document discharge unit TG2 which discharges the original documents Gi having passed through an original document reading position on the original document reading surface PG after being fed from the original document feeding unit TG1.

The apparatus body U2 includes a manipulation unit U1, through which a user inputs an operation indication signal such as an image forming operation start, an exposure optical system A and the like.

In the automatic original document carrying apparatus U1, a reflection light from an original document, which is carried on the original document reading surface PG or an original document loaded on the original document reading surface PG, is converted into an electrical signal of red (R), green (G) and blue (B) by a solid-state imaging device CCD via the exposure optical system A.

An information conversion unit IPS converts the electrical signal of RGB input from the solid-state imaging device CCD into image information of black (K), yellow (Y), magenta (M) and cyan (C), temporarily stores the image information, and then outputs the image information to a latent image forming circuit DL as image information for latent image formation at the preset time.

Further, when an original document image is a monochromatic image, only image information of black (K) is input to the latent image forming circuit DL.

The latent image forming circuit DL includes driving circuits (not shown) of Y, M, C and K, and outputs a signal corresponding to the input image information to latent image forming units LHy, LHm, LHc and LHk provided for each color at the preset time.

Figure 2:
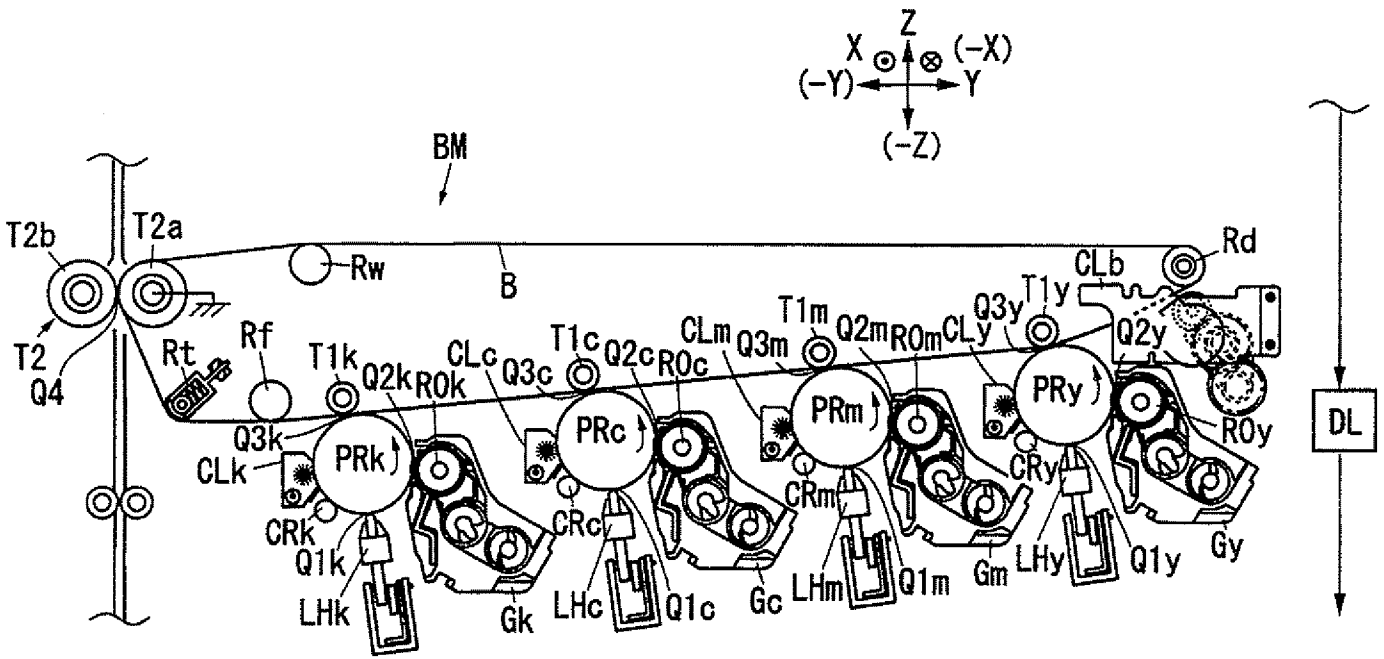
FIG. 2 is an enlarged view illustrating main elements of an image forming apparatus according to a first embodiment.

FIG. 2 is an enlarged view illustrating main elements of the image forming apparatus according to the first embodiment.

Visible image forming devices Uy, Um, Uc and Uk provided at the center portion of the gravitational direction of the copy machine U form visible images of each color of Y, M, C and K respectively.

Latent image writing lights Ly, Lm, Lc and Lk of Y, M, C and K, which are emitted from light sources of the latent image forming units LHy, LHm, LHc and LHk, are incident into photoreceptors PRy, PRm, PRc and PRk as one example of an image holder. Further, in the first embodiment, the latent image forming units LHy, LHm, LHe and LHk are prepared in the form of an apparatus, in which LEDs (Light Emission Diodes) serving as writing devices are linearly arranged in a row, that is, an LED array.

The visible image forming device Uy of Y includes the rotary photoreceptor PRy, a charger CRy, the latent image forming unit LHy, a developing device Gy, a primary transfer unit T1*y*, and a photoreceptor cleaner CLy as one example of an image holder cleaner. Further, in the first embodiment, the rotary photoreceptor PRy, the charger CRy and the photoreceptor cleaner CLy are prepared in the form of an image holder unit integrally attachable and detachable from the apparatus body U2.

Each of the visible image forming devices Urn, Uc and Uk has the same configuration as that of the visible image forming device Uy of Y.

In FIGS. 1 and 2, the photoreceptors PRy, PRm, PRc and PRk are charged by the chargers CRy, CRm, CRc, CRk, respectively. Then, latent images are formed on the surfaces of the photoreceptors PRy, PRm, PRc and PRk by the latent image writing lights Ly, Lm, Lc and Lk in image writing positions Q1*y*, Q1*m*, Q1*c* and Q1*k*. The latent images on the surfaces of the photoreceptors PRy, PRm, PRc and PRk are developed into toner images as one example of a visible image by developers held on developing rolls R0*y*, R0*m*, R0*c* and R0*k* as one example of a developer holder of developing devices Gy, Gm, Gc and Gk in development areas Q2*y*, Q2*m*, Q2*c* and Q2*k*.

The developed toner images are carried to primary transfer areas Q3*y*, Q3*m*, Q3*c* and Q3*k* being in contact with an intermediate transfer belt B as one example of an intermediate transfer unit. A primary transfer voltage with a polarity opposite to a charge polarity of toner is applied from a power circuit E controlled by a control unit C to primary transfer units T1*y*, T1*m*, T1*c* and T1*k*, which are disposed at the back side of the intermediate transfer belt B in the primary transfer areas Q3*y*, Q3*m*, Q3*c* and Q3*k*.

The toner images on the photoreceptors PRy, PRm, PRc and PRk are primarily transferred to the intermediate transfer belt B as one example of the intermediate transfer unit by the primary transfer units T1*y*, T1*m*, T1*c* and T1*k*. Residue and attachments on the surfaces of the photoreceptors PRy, PRm, PRc and PRk after the primary transfer are cleaned by photoreceptor cleaners CLy, CLm, CLc and CLk. The cleaned surfaces of the photoreceptors PRy, PRm, PRc and PRk are charged again by the chargers CRy, CRm, CRc, CRk, respectively.

A belt module BM as one example of an intermediate transfer device is disposed above the photoreceptors PRy, PRm, PRc and PRk. The belt module BM includes the intermediate transfer belt B, a belt driving roll Rd as one example of an intermediate transfer unit driving member, a tension roll Rt as one example of a tension applying member, a walking roll Rw as one example of a meandering prevention member, an idler roll Rf as one example of a driven member, a backup roll T2*a* as one example of a secondary transfer facing member, and the primary transfer units T1*y*, T1*m*, T1*c* and T1*k*. Further, the intermediate transfer belt B is rotatably and movably supported by the rolls Rd, Rt, Rw, Rf and T2*a*.

A secondary transfer roll T2*b* as one example of a secondary transfer member is disposed to face the surface of the intermediate transfer belt B being in contact with the backup roll T2*a*. A secondary transfer unit T2 is formed by the backup roll T2*a* and the secondary transfer roll T2*b*. Further, a secondary transfer area Q4 is formed by an area facing the secondary transfer roll T2*b* and the intermediate transfer belt B.

Monochromatic or multi-colored toner images, which are sequentially piled and transferred on the intermediate transfer belt B by the primary transfer units T1*y*, T1*m*, T1*c* and T1*k* in the primary transfer areas Q3*y*, Q3*m*, Q3*c* and Q3*k*, are carried to the secondary transfer area Q4.

Transfer devices T1+T2+B, which transfer the images formed on the photoreceptors PRy, PRm, PRc and PRk to a medium, according to the first embodiment are formed by the primary transfer units T1*y*, T1*m*, T1*c* and T1*k*, the intermediate transfer belt B, the secondary transfer unit T2 and the like.

A pair of right and left guide rails GR having a three-stage structure as one example of a guide member are provided below the visible image forming devices Uy, Urn, Uc and Uk. Feeding trays TR1 to TR3 as one example of a feeding unit are supported so as to move in the front and rear direction. In the guide rails GR, Recording sheets S as one example of media received in the feeding trays TR1 to TR3 are extracted by a pick-up roll Rp as one example of a medium extraction device, and then are separated one by one by a handling roll Rs as one example of a medium handling member. Further, the recording sheets S are carried by a plurality of carrying rolls Ra as one example of a medium carrying member along a sheet carrying path SH as one example of a medium carrying path, and then are sent to a register roll Rr as one example of a time adjustment member disposed at an upstream side of a sheet carrying direction of the secondary transfer area Q4. A sheet carrying device SH+Ra+Rr is formed by the sheet carrying path SH, the sheet carrying rolls Ra, the register roll Rr and the like.

The register roll Rr carries the recording sheet S to the secondary transfer area Q4 according to the time at which the toner image formed on the intermediate transfer belt B is carried to the secondary transfer area Q4. When the recording sheet S passes through the secondary transfer area Q4, the backup roll T2*a* is grounded, and a secondary transfer voltage with a polarity opposite to the charge polarity of the toner is applied to the secondary transfer roll T2*b* from the power circuit E controlled by the control unit C. At this time, the toner image on the intermediate transfer belt 13 is transferred to the recording sheet S by the secondary transfer unit T2.

The intermediate transfer belt B after the secondary transfer is cleaned by a belt cleaner CLb as one example of an intermediate transfer unit cleaner.

The recording sheet S, on which the toner image is secondarily transferred, is carried to a fixing area Q5 which is a contact area between a heating roll Fh as one example of a heating and fixing member of a fixing device F and a pressing roll Fp as one example of a pressing and fixing member, and heated and fixed when passing through the fixing area. The heated and fixed recording sheet S is discharged from a discharge roll Rh as one example of a medium discharge member to a discharge tray TRh as one example of a medium discharge unit.

Further, a release agent is coated on the surface of the heating roll Fh by a release agent coating device Fa to improve release properties of the recording sheet S from the heating roll.

Developer cartridges Ky, Km, Ke and Kk as one example of a developer receiving container, which receive developers of yellow Y, magenta M, cyan C and black K, are disposed above the belt module BM. The developers received in the developer cartridges Ky, Km, Ke and Kk are supplied to the developing devices Gy, Gm, Ge and Gk with the consumption of developers in the developing devices Gy, Gm, Gc and Gk. According to the first embodiment, the developers received in the developing devices Gy, Gm, Ge and Gk are formed by two-component developers including magnetic carrier and toner to which external additive is added, and so-called high density toner with a high ratio of toner with respect to a carrier is supplied from the developer cartridges Ky, Km, Ke and Kk, as compared with the developers in the developing devices Gy, Gm, Gc and Gk.

Figure 3A:
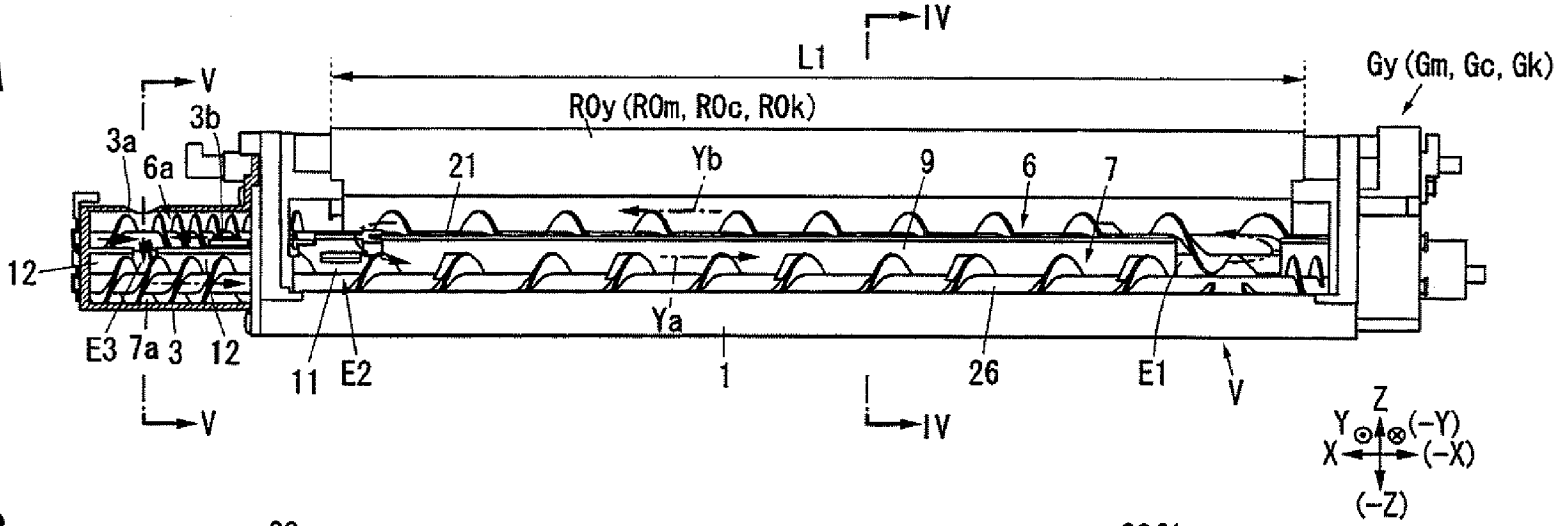
Figure 3B:
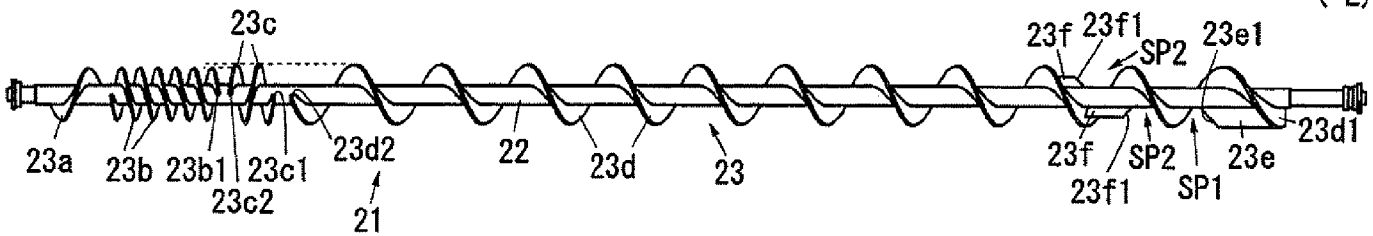
Figure 3C:
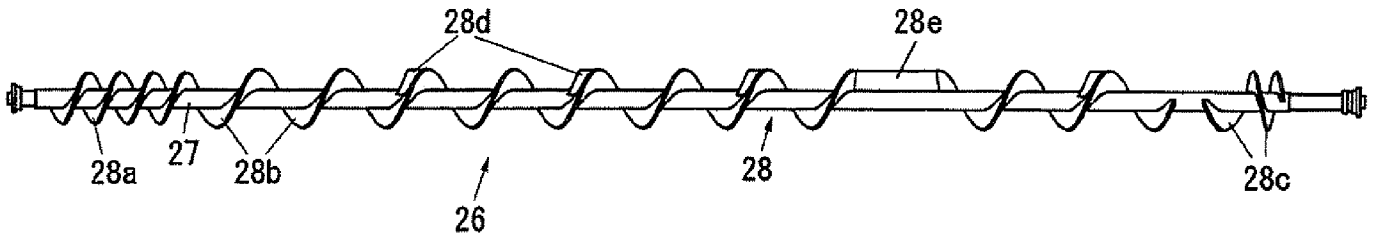

FIGS. 3A to 3C are diagrams illustrating the developing device according to the first embodiment of the present invention, in which FIG. 3A is a sectional perspective view illustrating main elements when a developing container cover is removed, FIG. 3B is a diagram illustrating a supply auger, and FIG. 3C is a diagram illustrating a stirring auger.

Figure 4:
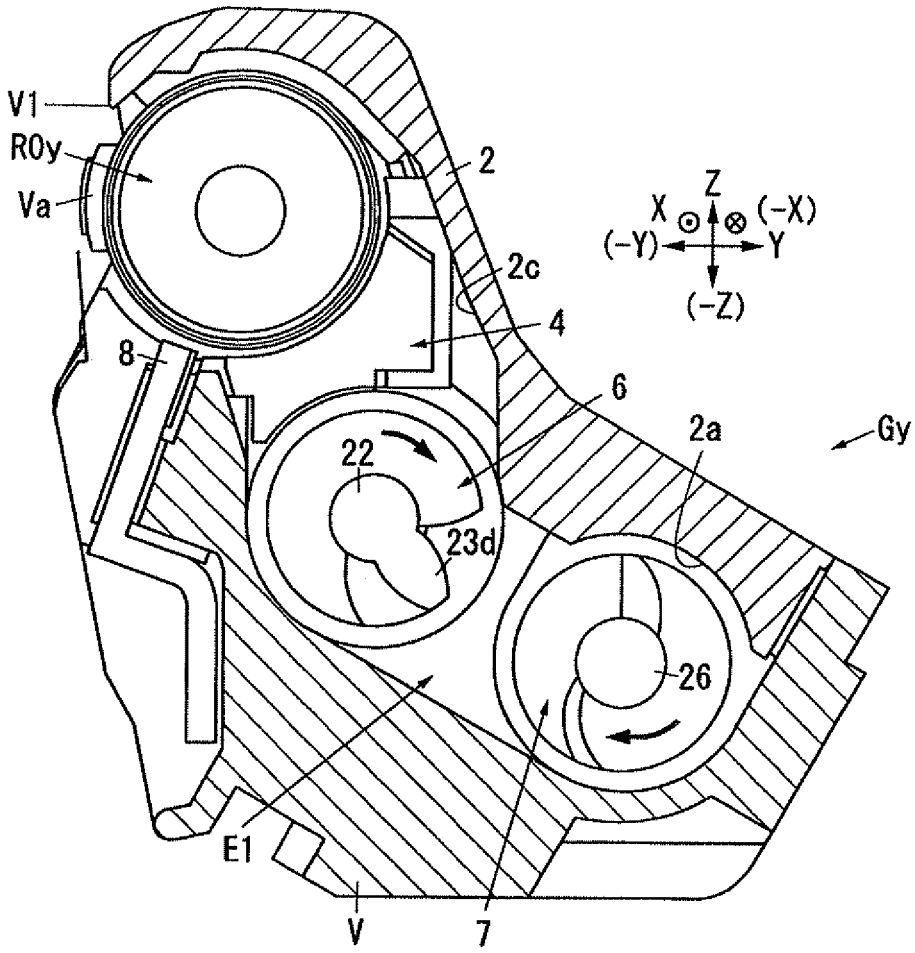
FIG. 4 is a sectional view taken along line IV-IV of FIG. 3A.

FIG. 4 is a sectional view taken along line 1V-1V of FIG. 3A.

Figure 5:
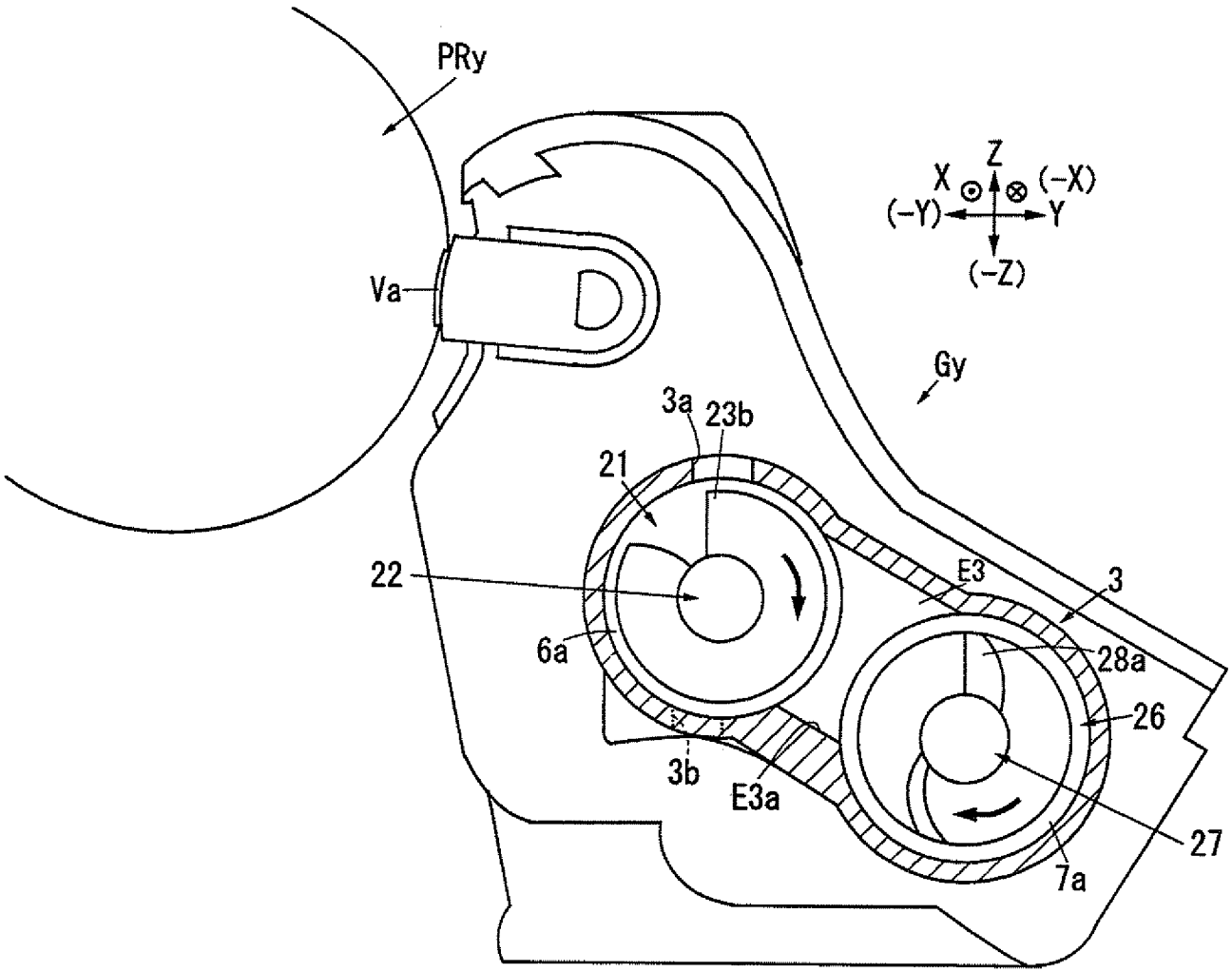
FIG. 5 is a sectional view taken along line V-V of FIG. 3A.

FIG. 5 is a sectional view taken along line V-V of FIG. 3A.

Next, the developing devices Gy, Gm, Gc and Gk according to the first embodiment of the present invention will be described. However, since the developing devices Gy, Gm, Gc and Gk of each color have the same configuration, only the developing device Gy of a Y color will be described in detail, and detailed description of the developing devices Gm, Ge and Gk of other colors will be omitted.

In FIGS. 2 to 5, the developing device Gy facing the photoreceptor PRy includes a development container V that receives the two-component developers including the toner and the carrier. The development container V includes a development container body 1, a development container cover 2 that covers the upper end of the development container body 1 as one example of a cover member as shown in FIG. 4, and a supply and disposal tube 3 connected to the front end of the development container body 1 as one example of a supply and disposal unit as shown in FIG. 3A to 3C, In FIG. 4, the development container V according to the first embodiment is formed with an opening V1 corresponding to the development area Q2*y* facing the photoreceptor Pry, and is opened.

In FIGS. 2 to 4, the development container body 1 is provide therein with a developing roll chamber 4 as one example of a holder receiving unit, a first stirring chamber 6 as one example of a first chamber, and a second stirring chamber 7 as one example of a second chamber. The first stirring chamber 6 is adjacent to the developing roll chamber 4. The second stirring chamber 7 is adjacent to the right oblique lower portion of the first stirring chamber 6 to reduce the size of the transverse and longitudinal direction of the development container V. A developing roll R0*y* as one example of a developer holder is received in the developing roll chamber 4, and a part of an outer surface of the developing roll R0*y* is exposed to the photoreceptor PRy in the opening V1 while facing the photoreceptor PRy. A layer thickness regulation member 8 is provided at an upstream side of the rotation direction of the developing roll R0*y* to restrict the layer thickness of the developer on the surface of the developing roll R0*y*.

Further, in FIG. 4, abutment members Va (i.e., tracking members) are provided at both front and rear end portions of the development container V while facing the photoreceptor Pry to maintain a predetermined gap between the developing roll R0*y* and the photoreceptor Pry.

In FIG. 3A to 3C, a supply and disposal chamber 6*a* in the supply and disposal tube 3 is connected to the front side of the first stirring chamber 6, and a supply chamber 7*a* in the supply and disposal tube 3 is connected to the front side of the second stirring chamber 7. In FIG. 3A to 3C, a developer supply port 3*a* as one example of a new developer inlet portion is formed in the upper surface of the front end portion of the supply and disposal chamber 6*a* to allow developers to be supplied from the developer cartridges Ky, Km, Kc and Kk. Further, in FIGS. 3A to 3C and 5, a developer discharge port 3*b* as one example of a developer discharge unit is formed in the lower surface of the rear portion of the supply and disposal chamber 6*a*, and deteriorated developers in the supply and disposal chamber 6*a* are discharged from the developer discharge port 3*b*, so that internal carriers are exchanged little by little.

As shown in FIG. 3A to 3C, a partition wall 9 is provided between the first stirring chamber 6 and the second stirring chamber 7, except for both ends of the development container body 1. In FIGS. 3A to 3C and 4, the first stirring chamber 6 and the second stirring chamber 7 communicate with each other in an ascending inlet portion E1 as one example of a first inlet portion disposed at the rear end portion of the partition wall 9, and a descending inlet portion E2 as one example of a second inlet portion disposed at the front side of the partition wall 9. The ascending inlet portion E1 and the descending inlet portion E2 are configured to facilitate the circulation of developers. The descending inlet portion E2 is provided with an opening forming member 11 formed with an opening for adjusting the inlet flow.

In FIG. 3A, according to the first embodiment, the ascending inlet portion E1 overlaps the width L1 of the development area Q2*y*, on which development is performed by the developing roll R0*y*, and a part of the descending inlet portion E2 overlaps the width L1 of the development area Q2*y*.

Further, in the developer supply and disposal tube 3, a partition wall 12 is formed between the supply and disposal chamber 6*a* and the supply chamber 7*a*. Thus, as shown in FIG. 3A to 3C, the supply and disposal chamber 6*a* and the supply chamber 7*a* communicate with each other in a supply inlet portion E3 as one example of a third inlet portion, and developers are introduced from the supply and disposal chamber 6*a* to the supply chamber 7*a*.

A circulation stirring chamber 6+7 is formed by the first stirring chamber 6 and the second stirring chamber 7.

In FIGS. 3A to 3C and 4, the first stirring chamber 6 is provided therein with a supply auger 21 as one example of a first carrying member for stirring and carrying developers and a supply member for supplying the developers to the developing roll R0*y*.

In FIGS. 3A and 3B, the supply auger 21 includes a first rotating shaft 22, which extends in parallel to the axial direction of the developing roll R0*y*, and a first carrying blade 23 supported on an outer periphery of the first rotating shaft 22 and having a spiral shape. The first carrying blade 23 includes a first supply carrying blade 23*a* as one example of a carrying blade, a discard carrying blade 23*b* as one example of a fourth carrying part, a circulation carrying blade 23*c* as one example of a reverse carrying part for circulation, and a first main carrying blade 23*d* as one example of a first carrying part. The first supply carrying blade 23*a* is disposed corresponding to the front end portion of the supply and disposal chamber 6*a*, and the discard carrying blade 23*b* is disposed corresponding to the rear portion from the center portion of the supply and disposal chamber 6*a*. The circulation carrying blade 23*c* is disposed corresponding to the front side of the descending inlet portion E2 from the rear end portion of the supply and disposal chamber 3*a*, and the first main carrying blade 23*d* is disposed corresponding to the rear end portion of the first stirring chamber 6 from the descending inlet portion E2.

The carrying blades 23*a* to 23*d* according to the first embodiment have a spiral shape, respectively. The winding direction of the first supply carrying blade 23*a* is opposite to that of the discard carrying blade 23*b*, the winding direction of the discard carrying blade 23*b* is opposite to that of the circulation carrying blade 23*c*, and the winding direction of the circulation carrying blade 23*e* is opposite to that of the first main carrying blade 23*d*.

Further, the distance by which developers are moved through one rotation of the first main carrying blade 23*d*, that is, an interval between blades adjacent to each other in the axial direction, in other words, a pitch is set to be larger than each of the carrying blades 23*a* to 23*c*. In addition, in FIGS. 4 and 5, according to the first embodiment, a sectional area of the supply and disposal chamber 6*a* is smaller than that of the first stirring chamber 6, so that outer diameters of the supply carrying blade 23*a* and the discard carrying blade 23*b* disposed in the supply and disposal chamber 6*a* are smaller than those of the circulation carrying blade 23*c* and the first main carrying blade 23*d* disposed in the first stirring chamber 6 as shown in FIG. 3B.

Moreover, the supply auger 21 according to the first embodiment is moved in the sequence of the upper portion in the gravitational direction, the second developer receiving chamber-side and the lower portion in the gravitational direction in the ascending inlet portion E1 as shown in FIG. 4. Similarly to this, the supply auger 21 is moved in the supply inlet portion E3 shown in FIG. 5 which will be described later.

Figures 6A, 6B, 6C:
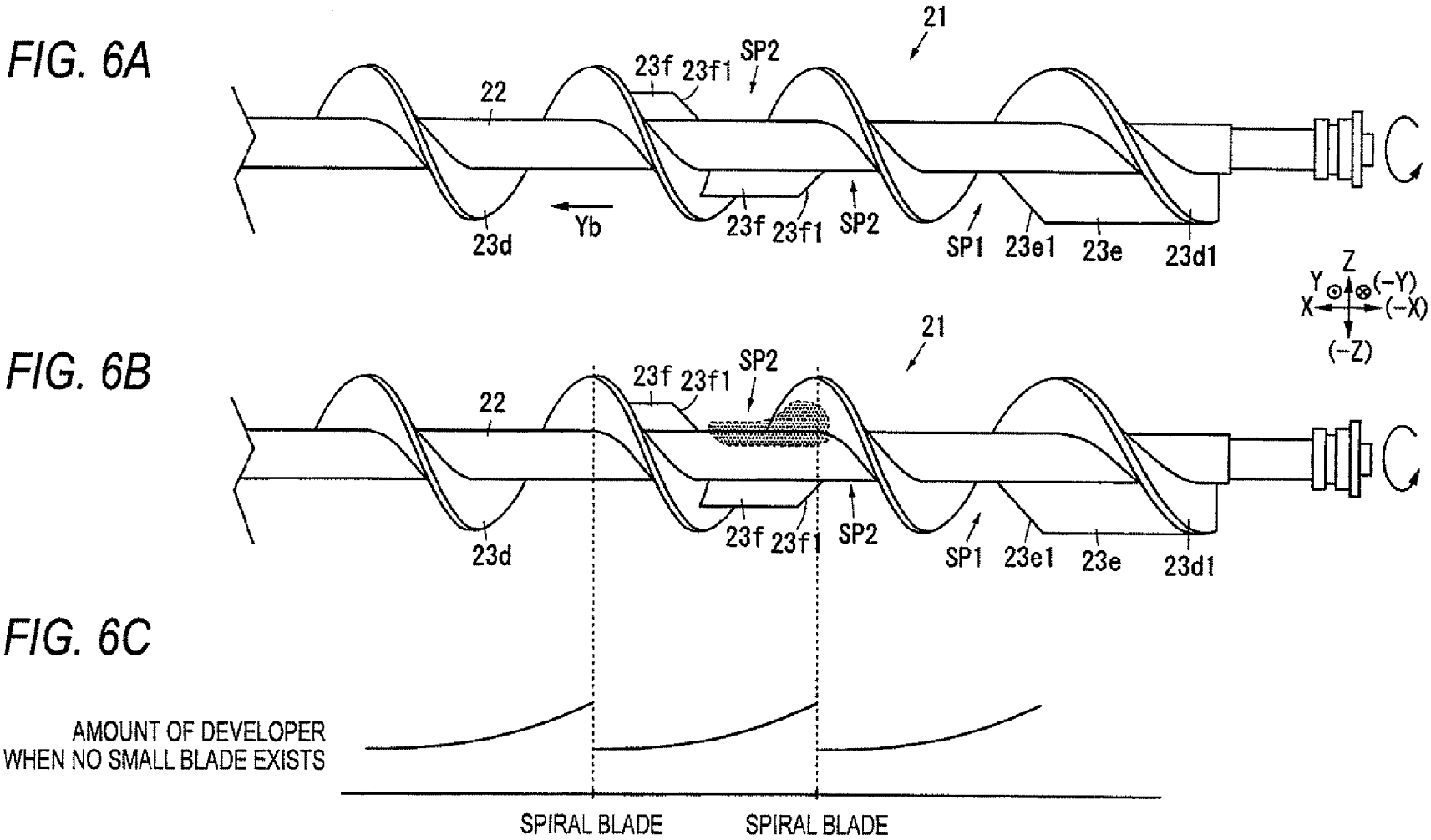

FIGS. 6A to 6C are diagrams illustrating an upstream end portion of the supply auger according to the first embodiment, in which FIG. 6A is an enlarged view illustrating main elements of the supply auger, FIG. 6B is a diagram illustrating the carrying of developers by a blade, and FIG. 6C is a diagram illustrating the amount of developers interposed between blades.

In FIGS. 3B and 6A to 6C, a rear end blade 23*d*1 corresponding to one winding of the first main carrying blade 23*d* having a spiral shape, which is located at a rear end (i.e., an upstream end) of the supply auger 21, has a pitch larger than that of the other blades in the first carrying direction Yb serving as a direction in which developers are carried by the first main carrying blade 23*d*. Thus, the rear end blade 23*d*1 of the first main carrying blade 23*d* is inclined with respect to the first rotating shaft 22, that is, is in a resting state, as compared with the other blades. Consequently, while an ability of the rear end blade 23*d*1 to carry developers in the axial direction is reduced, and an ability of the rear end blade 23*d*1 to carry developers toward the developing roll R0*y* is increased, as compared with the other blades.

In FIGS. 3B and 6A to 6C, the supply auger 21 is provided at the rear end portion thereof with an upstream end paddle 23*e* as one example of a feeding blade. The upstream end paddle 23*e* according to the first embodiment has a plate shape to extend along the axial direction of the first rotating shaft 22. Further, the upstream end paddle 23*e* has an upstream end connected to the rear end blade 23*d*1, and a gap SP1 is formed between a downstream end surface 23*e*1 of the upstream end paddle 23*e* and the first main carrying blade 23*d* of the downstream side. In addition, according to the first embodiment, an outer end of a radial direction of the downstream end surface 23*e*1 of the upstream end paddle 23*e* is inclined toward a direction separated from the first rotating shaft 22 as it is toward a direction of the rear side (i.e., the upstream side).

Moreover, the outer diameter of the upstream end paddle 23*e* according to the first embodiment, except for the inclined downstream end surface 23*e*1, is set to be equal to that of the first main carrying blade 23*d*. Further, the upstream end paddle 23*e* is disposed corresponding to the ascending inlet portion E1 in such a manner that the upstream end paddle 23*e* and the ascending inlet portion E1 partially overlap each other.

In FIGS. 3B and 6A to 6C, a small blade 23*f* as one example of an auxiliary blade is provided in front of the upstream end paddle 23*e*. The small blade 23*f* according to the first embodiment has a plate shape to extend along the axial direction of the first rotating shaft 22. Further, a downstream end of the small blade 23*f* is connected to the first main carrying blade 23*d*, and a gap SP2 is formed between an upstream end surface 2311 of the small blade 23*f* and the first main carrying blade 23*d* of the upstream side. In addition, according to the first embodiment, an outer end of a radial direction of the upstream end surface 2311 of the small blade 23*f* is inclined toward a direction separated from the first rotating shaft 22 as it is toward a direction of the front side (i.e., the downstream side).

Moreover, the outer diameter of the small blade 23*f* according to the first embodiment, except for the inclined upstream end surface 2311, is set to be smaller than those of the first main carrying blade 23*d* and the upstream end paddle 23*e*.

Further, the small blade 23*f* is disposed at the downstream side as compared with the ascending inlet portion E1, and a front end of the upstream end surface 2311 of the small blade 23*f* is disposed adjacent to the downstream end of the ascending inlet portion E1. In addition, a part of the upstream end surface 2311 of the small blade 23*f* may overlap the ascending inlet portion E1, or the ascending inlet portion E1 may not overlap the small blade 23*f*.

Moreover, in the supply auger 21 according to the first embodiment, two small blades 23*f* having phases, which are different from each other by 180°, are disposed in the rotation direction of the first rotating shaft 22.

Figure 7:
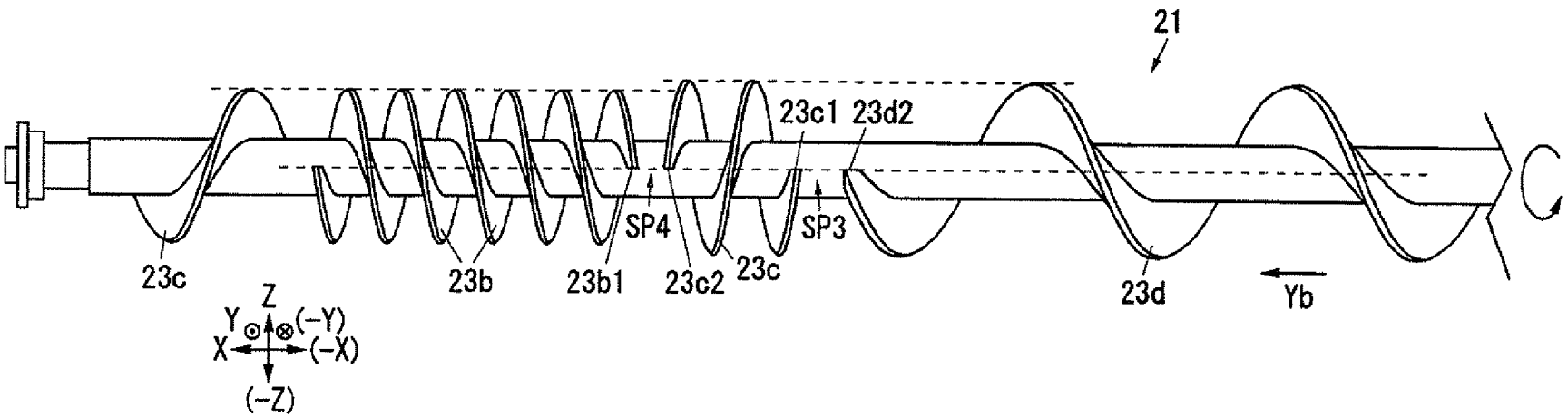
FIG. 7 is an enlarged view illustrating main elements of a downstream end portion of a supply auger according to a first embodiment.

FIG. 7 is an enlarged view illustrating main elements of a downstream end portion of the supply auger according to the first embodiment.

Referring to FIGS. 3B and 7, in the supply auger 21 according to the first embodiment, a front end 23*d*2 serving as the downstream end of the first main carrying blade 23*d* is separated from a rear end 23*c*1 serving as the upstream end of the circulation carrying blade 23*c* in the axial direction of the first rotating shaft 22, and a gap SP3 is formed between the front end 23*d*2 and the rear end 23*c*1. Further, the front end 23*d*2 of the first main carrying blade 23*d* has the same phase as that of the rear end 23*c*1 of the circulation carrying blade 23*c* with respect to the rotation direction of the first rotating shaft 22.

In addition, according to the first embodiment, the circulation carrying blade 23*c* is formed by two windings necessary for making two circuits around the first rotating shaft 22. That is, the number of windings is set to 2.

Similarly to this, a front end 23*c*2 of the circulation carrying blade 23*c* is separated from a rear end 23*b*1 serving as the upstream end of the discard carrying blade 23*b* in the axial direction, and a gap SP4 is formed therebetween. Further, the front end 23*c*2 of the circulation carrying blade 23*c* has the same phase as that of the rear end 23*b*1 of the discard carrying blade 23*b* with respect to the rotation direction of the first rotating shaft 22.

In addition, in the supply auger 21 according to the first embodiment, the first rotating shaft 22 is integrally formed with the first carrying blade 23 by using resin. However, after the shaft is formed separately from the carrying blade, they may be combined with each other. Moreover, according to the first embodiment, the carrying blades 23*a* to 23*d* are provided to one first rotating shaft 22. However, the invention is not limited to such a configuration. For example, a carrying blade may be formed separately from a rotating shaft in the form of the first supply carrying blade 23*a* and a rotating shaft thereof, the discard carrying blade 23*b* and a rotating shaft thereof, the circulation carrying blade 23*c* and a rotating shaft thereof, and the first main stirring and carrying blade 23*d* and a rotating shaft thereof.

In FIGS. 3A and 3C, the second stirring chamber 7 is provided therein with a stirring auger 26 as one example of a second carrying member for stirring and carrying developers and a stirring member for stirring the developers. The stirring auger 26 includes a second rotating shaft 27, which extends along the axial direction of the developing roll R0*y*, and a second carrying blade 28 supported on an outer periphery of the second rotating shaft 27 and having a spiral shape. The second carrying blade 28 includes a second supply carrying blade 28*a* disposed corresponding to the supply chamber 7*a*, a second main carrying blade 28*b* disposed corresponding to the front side of the ascending inlet portion E1 from the descending inlet portion E2, and a reverse carrying blade 28*c* disposed at the rear end portion of the second stirring chamber 7.

In addition, according to the first embodiment, each of the blades 28*a* to 28*c* has a spiral shape, and the second main carrying blade 28*b* has a pitch larger than that of each of the carrying blades 23*a* to 23*d*. Moreover, as shown in FIGS. 3A to 3C, the second main carrying blade 28*b* is provided with a plurality of flat-plate shaped stirring members 28*d* formed at a predetermined interval while being supported by the second rotating shaft 27. In FIG. 3C, a stirring paddle 28*e* as one example of a stirring portion is provided at the left side of the reverse carrying blade 28*c* and is supported by the second rotating shaft 27. In relation to the stirring member 28*d* and the stirring paddle 28*e*, a carrying force in the circumferential direction is larger than a carrying force along the axial direction of the second rotating shaft 27. Particularly, according to the first embodiment, the stirring member 28*d* and the stirring paddle 28*e* are made of a material having a plate shape along the second rotating shaft 27, and carrying force of the axial direction due to the stirring member 28*d* and the stirring paddle 28*e* rarely exists.

Similarly to the supply auger 21, the stirring auger 26 according to the first embodiment is also integrally formed. In addition, according to the first embodiment, the blades 28*a* to 28*c* are provided to one second rotating shaft 27. However, the invention is not limited to such a configuration. For example, a carrying blade may be formed separately from a rotating shaft in the form of the second supply carrying blade 28*a* and a rotating shaft thereof, the second main carrying blade 28*b* and a rotating shaft thereof, and the reverse carrying blade 28*c* and a rotating shaft thereof.

If each carrying member 21 or 26 rotates, developers supplied from the developer supply port 3*a* are introduced to the supply inlet portion E3 by the first supply carrying blade 23*a* and the discard carrying blade 23*b*, and then are carried to the supply chamber 7*a*. The developers carried to the supply chamber 7*a* are carried to the second stirring chamber 7 in the development container body 1 by the second supply carrying blade 28*a*, and then are carried in the second carrying direction Ya by the second main carrying blade 28*b*. The developers carried to the ascending inlet portion E1 are made to stay by the second main carrying blade 28*b* and the reverse carrying blade 28*c*, which carries developers in the direction opposite to the second carrying direction, so that the amount of the developers is increased. Then, the developers are carried to the first stirring chamber 6 located diagonally above. At this time, according to the first embodiment, since the second stirring chamber 7 is disposed adjacent to the right oblique lower portion of the first stirring chamber 6, the stirring auger 26 disposed in the second stirring chamber 7 rotates in the clockwise direction in FIG. 4, that is, in the sequence of the lower portion in the gravitational direction, a side facing the first stirring chamber 6 and the upper portion in the gravitational direction. At the time of the rotation of the stirring auger 26, the developers are carried to the left upper portion by the second main carrying blade 28*b* and the reverse carrying blade 28*c*, that is, the developers are carried in such a manner that the developers approach the first stirring chamber 6 so as to be lifted up, so that the introduction of the developers to the first stirring chamber 6 is supported.

The developers introduced to the first stirring chamber 6 are carried in the first developer carrying direction Yb opposite to the second developer carrying direction Ya by the first main carrying blade 23*d*. The developers carried to the first stirring chamber 6 are attached to the surface of the developing roll R0*y* by a magnetic force during the carrying, and are used for development. The developers carried to the descending inlet portion E2 are made to stay in the descending inlet portion E2 due to the circulation carrying blade 23*c* which carries developers in the direction opposite to the first developer carrying direction Yb, and then are introduced to the second stirring chamber 7 through the descending inlet portion E2 by gravity. As a result, the developers in the stirring chambers 6 and 7 are stirred by the stirring members 21 and 26 so as to be circulated and carried.

Further, if the developers of the descending inlet portion E2 are increased, a case may occur in which a part of the developers are introduced to the discard carrying blade 23*b* of the supply and disposal chamber 7*a* without being carried in the opposite direction by the circulation carrying blade 23*c*. In such a case, the developers introduced to the discard carrying blade 23*b* after passing through the circulation carrying blade 23*c* are carried to the developer discharge port 3*b* by the discard carrying blade 23*b* so as to be discarded. Thus, deteriorated developers due to a load during the development are discarded from the developer discharge port 3*b* slowly.

In the copy machine U having the above configuration according to the first embodiment, developers circulated in the developing devices Gy, Gm, Ge and Gk are lifted up and pumped in the ascending inlet portion E1 in the direction opposite to the gravitational direction, and then the pumped developers are carried to the downstream side by the supply auger 21. However, in the developing devices Gy, Gm, Ge and Gk in which the ascending inlet portion E1 exists in the width L1 of the development areas Q2*y*, Q2*m*, Q2*c* and Q2*k*, if the pumped developers are carried at a high speed by the supply auger 21, the rear end portion of the developing roll R0*y* lacks developers, so that a shortage in the supply of developers may occur in the developing rolls R0*y*, R0*m*, R0*c* and R0*k*, resulting in the occurrence of image formation failure. In this regard, according to the first embodiment, since the upstream side paddle 23*e* having no ability to carry developers is disposed corresponding to the end portion of the developing rolls R0*y*, R0*m*, R0*c* and R0*k*, carrying performance, carrying ability and carrying speed of the developers pumped to the first stirring chamber 6 are reduced, and the upstream side paddle 23*e* sends the developers toward the developing rolls R0*y*, R0*m*, R0*c* and R0*k*. Consequently, a short in the supply of developers can be prevented from occurring in the end portion of the developing rolls R0*y*, R0*m*, R0*c* and R0*k*, and development unevenness and density unevenness can be prevented from occurring in the axial direction of the developing rolls R0*y*, R0*m*, R0*c* and R0*k*.

Further, according to the first embodiment, an inclination angle of the rear end blade 23*d*1 of the first main carrying blade 23*d* is small as compared with the other blades, and is adjacent to the upstream side paddle 23*e*, so that the carrying ability thereof is reduced. Consequently, developers can be easily supplied to the end portion of the developing rolls R0*y*, R0*m*, R0*c* and R0*k*, and a shortage in the supply of developers can be prevented.

In addition, according to the first embodiment, the gap SP1 is formed between the downstream end surface 23*e*1 of the upstream end paddle 23*e* and the first main carrying blade 23*d* of the downstream side, so that the developer carrying ability can be prevented from being reduced and a shortage in the supply of developers can be prevented from occurring in the downstream side of the upstream end paddle 23*e*, as compared with the case in which the gap SP1 is not formed.

Moreover, according to the first embodiment, the downstream end surface 23*e*1 of the upstream end paddle 23*e* is inclined such that the diameter thereof is increased toward the rear side. However, in the case in which the downstream end surface 23*e*1 is not inclined and extends in the radial direction perpendicular to the first rotating shaft 22, the developer carrying ability may be discontinuously changed and density unevenness may occur in the end portion of the developing rolls R0*y*, R0*m*, R0*c* and R0*k* when the downstream end surface 23*e*1 is set as a boundary. In this regard, in the supply auger 21 according to the first embodiment in which the downstream end surface 23*e*1 is inclined, the carrying force is changed slowly and density unevenness can be prevented from occurring in the end portion of the developing rolls R0*y*, R0*m*, R0*c* and R0*k*.

Furthermore, according to the first embodiment, the small blade 23*f* is formed at the downstream side of the upstream end paddle 23*e*, so that the force carrying developers is reduced. Consequently, the upstream end paddle 23*e* reduces the carrying ability, and the amount of developers carried to the downstream side at which the small blade 23*f* is disposed is reduced, as compared with the configuration in which the small blade 23*f* is not provided. For example, if the total amount of developers in the developing devices Gy, Gm, Gc and Gk is reduced due to the continuous development and the like in the state in which the developer cartridges Ky, Km, Kc and Kk are empty, a shortage in the supply of developers may occur in the downstream side of the upstream side paddle 23*e*. In this regard, according to the first embodiment, the small blade 23*f* having a low developer carrying ability is disposed at the downstream side of the upstream side paddle 23*e* to reduce the carrying ability, so that developers can be easily gathered and a shortage in the supply of developers can be prevented. Particularly, the small blade 23*f* according to the first embodiment has a short length in the radial direction, and rarely performs a function of reducing the carrying ability as compared with the upstream end paddle 23*e*, so that a shortage in the supply of developers can be prevented from occurring in the downstream side of the small blade 23*f* without the reduction in the carrying ability.

Further, the small blade 23*f* according to the first embodiment extends toward the upstream side from the first main carrying blade 23*d*. That is, when the first main carrying blade 23*d* having a spiral shape carries developers, the developers are carried while being pressed toward the downstream side by the downstream side surface of the first main carrying blade 23*d* as shown in FIG. 6, so that a relatively large amount of developers exists in the downstream side of the first main carrying blade 23*d* and a small amount of developers exists in the upstream side thereof, resulting in the distribution of developers as shown in FIG. 6C. In this regard, according to the first embodiment, the small blade 23*f* is provided at the upstream side of the first main carrying blade 23*d* to allow developers to remain without difficulty, so that variation (i.e., unevenness) of the distribution of developers can be reduced.

In addition, the gap SP2 is formed between the small blade 23*f* according to the first embodiment and the first main carrying blade 23*d*, so that the carrying force can be prevented from being reduced, similarly to the case of the upstream end paddle 23*e*. Moreover, the upstream end surface 23*f*1 of the small blade 23*f* according to the first embodiment is inclined such that the radius thereof is increased toward the downstream side, so that the carrying ability can be prevented from being discontinuously changed and density unevenness can be prevented from occurring, similarly to the case of the upstream end paddle 23*e*.

Figure 8A:
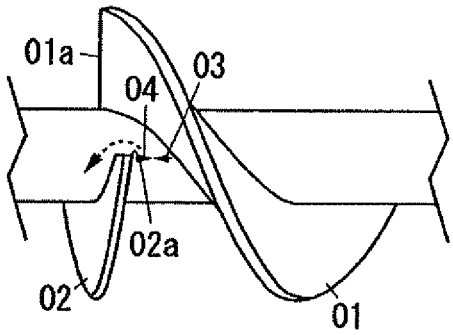
Figure 8C:
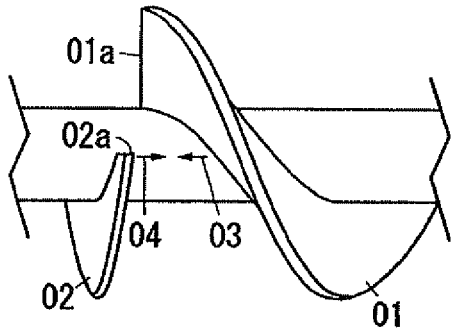
Figure 8B:
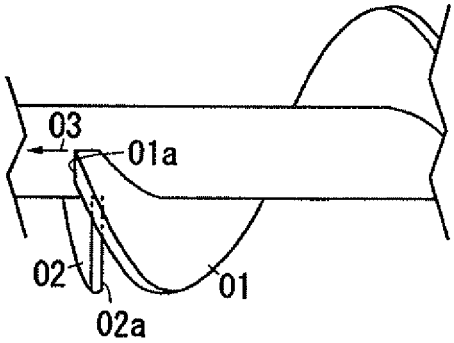
Figure 8D:
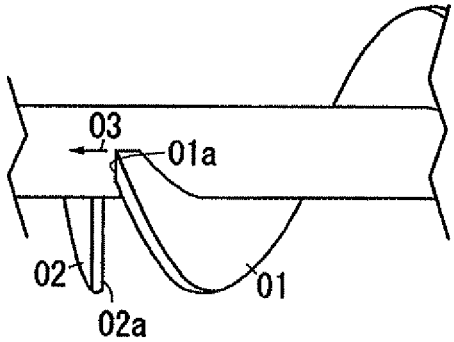

FIGS. 8A to 8D are diagrams illustrating a conventional developer carrying member, in which FIG. 8A is a diagram illustrating the configuration in which no gap is fanned in the developer carrying member, FIG. 8B is a diagram illustrating the state in which the state shown in FIG. 8A is rotated by 90°, FIG. 8C is a diagram illustrating the configuration in which a phase is not synchronized, and FIG. 8D is a diagram illustrating a state in which the state shown in FIG. 8C is rotated by 90°.

Referring to FIGS. 8A to 8D, in the conventional developer carrying member, end portions of carrying blades 01 and 02, which carry developers in directions opposite to each other, partially overlap each other along the axial direction as shown in FIGS. 8A and 8B. Further, phases of the end portions are not synchronized as shown in FIGS. 8C and 8D. Alternatively, the two cases may occur.

In FIGS. 8A and 8B, when a front end 01*a* of the first main carrying blade 01 is provided at a front portion as compared with a rear end 02*a* of the circulation carrying blade 02, a gap, in which a blade is not disposed along the axial direction, is not formed, as with the gap SP3 shown in FIG. 7 according to the first embodiment. Thus, developers carried by the first main carrying blade 01 in the first carrying direction 03 collide with developers carried by the circulation carrying blade 02 in the opposite direction 04, and are made to stay without a reduction in a carrying speed. Consequently, the developers may be rapidly deteriorated due to a load applied thereto.

Differently from the above case, in the supply auger 21 shown in FIG. 7 according to the first embodiment, the gap SP3, in which a blade is not disposed along the axial direction, is formed between the front end 23*d*2 of the first main carrying blade 23*d* and the circulation carrying blade 23*c*, so that developers carried by the first main carrying blade 23*d* collide with developers from the circulation carrying blade 23*c* of the downstream side in the state in which a carrying speed thereof is reduced in the gap SP3. Consequently, according to the first embodiment, as compared with a supply auger without the gap SP3, developers can be prevented from being deteriorated in the descending inlet portion E2. In addition, as compared with the supply auger without the gap SP3, developers carried by the first main carrying blade 23*d* remain in the gap SP3 without difficulty, so that developers can be efficiently introduced to the descending inlet portion E2.

Further, when the phases are not synchronized as shown in FIGS. 8C and 8D or when the front end 01*a* of the first main carrying blade 01 is provided at the front portion as compared with the rear end 02*a* of the circulation carrying blade 02, developers carried in the rear end 02*a* of the circulation carrying blade 02 in the opposite direction 04 are pressed by the first main carrying blade 01 and are returned such that they enter the upstream side of the circulation carrying blade 02. Thus, it is difficult for developers to sufficiently stay in the boundary between the first main carrying blade 01 and the circulation carrying blade 02, and the developers reciprocate in the same place and are not easily discharged from the descending inlet portion E2, so that developers may not be smoothly changed and may be deteriorated.

Differently from the above case, in the supply auger 21 shown in FIG. 7 according to the first embodiment, the front end 23*d*2 of the first main carrying blade 23*d* and the rear end 23*c*1 of the circulation carrying blade 23*e* are set to have the same phase, so that developers can be prevented from being returned to the opposite side, as compared with the cases shown in FIGS. 8A to 8D. Consequently, developers can remain in the gap SP3 without difficulty, so that developers can be efficiently introduced to the descending inlet portion E2. In addition, developers can be prevented from reciprocating in the same place and can be easily changed, so that the developers can be prevented from being deteriorated. Particularly, even if the carrying speed of developers of the supply auger 21 is high, developers carried by the first main carrying blade 23*d* are returned in order to sufficiently maintain their ability to remain and be introduced, and the change of developers is circulated, so that developers can be prevented from being deteriorated.

Referring to FIG. 7, in the supply auger 21 according to the first embodiment, similarly to the front end 23*d*2 of the first main carrying blade 23*d* and the rear end 23*c*1 of the circulation carrying blade 23*c*, the gap SP4 is formed between the front end 23*c*2 of the circulation carrying blade 23*c* and the rear end 23*b*1 serving as the upstream end of the discard carrying blade 23*b*, and the front end 23*c*2 of the circulation carrying blade 23*c* has the same phase as that of the rear end 23*b*1 of the discard carrying blade 23*b*. Consequently, in an area corresponding to the gap SP4, the carrying speed of developers is reduced and the change of developers is easily performed, so that developers can be prevented from being deteriorated.

Further, referring to FIG. 7, in the supply auger 21 according to the first embodiment, the number of windings of the circulation carrying blade 23*c* is set to 2, so that the ability to introduce developers to the descending inlet portion E2 is improved as compared with the case in which the number of windings is set to 1 and 1.5. Consequently, since an image forming speed of the copy machine U, that is, productivity, is improved, even if the carrying speed by the first main carrying blade 23*d* is increased, developers are carried to the descending inlet portion E2, so that developers discharged from the discharge port 3*b* after passing through the circulation carrying blade 23*c* can be prevented from being excessively increased.

In addition, according to the supply auger 21 of the first embodiment, in an area corresponding to the gap SP4, the carrying speed of developers is reduced and developers are allowed to remain without difficulty. Consequently, after the total amount of developers in the development container V is temporarily increased and developers introduced in the gap SP4 after passing through the circulation carrying blade 23*c* are increased, if the total amount of developers is reduced, the amount of developers staying in the gap SP4 may be increased as compared with the areas of the circulation carrying blade 23*c* and the discard carrying blade 23*b*. At this time, the circulation carrying blade 23*c* according to the first embodiment is formed by two windings, and developers in the gap SP4 are carried to an intermediate portion of the gap SP4 and the descending inlet portion E2 in the state in which the circulation carrying blade 23*c* has rotated once. In contrast, when the circulation carrying blade 23*c* is formed by one winding and developers in the gap SP4 are locally increased, if the locally increased developers are carried to the descending inlet portion E2 through one rotation of the circulation carrying blade 23*c*, the developers collide with developers carried by the first main carrying blade 23*d*, so that a load with respect to developers increases, resulting in the deterioration of developers. In this regard, according to the first embodiment, in the case in which developers in the gap SP4 are carried by the circulation carrying blade 23*c*, the developers are carried to an intermediate portion between the gap SP4, in which the amount of developers is relatively small, and the descending inlet portion E2 so as to be uniform when the circulation carrying blade 23*c* rotates once, as compared with the gap SP4 and the descending inlet portion E2. Then, if the circulation carrying blade 23*c* rotates twice, the developers are carried to the descending inlet portion E2, so that a load with respect to the developers is reduced, resulting in the prevention of deterioration of the developers.

While there have been described what are at present considered to be a certain embodiment of the invention, it will be understood that various modifications may be made thereto, and it is intended that the appended claims cover all such modifications as fall within the true spirit and scope of the invention. Hereinafter, modified examples H01 to H012 of the invention will be described.

(H01) In the previous embodiment, a copy machine is exemplified as an image forming apparatus. However, the invention is not limited thereto. For example, the image forming apparatus may be formed by a printer, a facsimile or a multifunctional device having a plurality of functions or all functions thereof.

(H02) In the previous embodiment, the copy machine U uses developers of four colors. However, the invention is not limited thereto. For example, the invention can also be applied to a monochromatic image forming apparatus and a multicolored image forming apparatus of five colors or more or three colors or less.

(H03) In the previous embodiment, it is preferred that the gaps SP1 and SP2 are formed between the upstream end paddle 23*e* and the small blade 23*f* and between the small blade 23*f* and the first main carrying blade 23*d*, respectively. However, the upstream end paddle 23*e* and the small blade 23*f* may be connected to the first main carrying blade 23*d* without any gap. In contrast, an end of one of the upstream end paddle 23*e* and the small blade 23*f* may be connected to the first main carrying blade 23*d*, or ends of both of the upstream end paddle 23*e* and the small blade 23*f* may be separated from the first main carrying blade 23*d*.

(H04) In the previous embodiment, it is preferred that the end surface 23*e*1 of the upstream end paddle 23*e* and the end 23*f*1 of the small blade 23*f* are inclined. However, the end surfaces 23*e*1 and 2311 may extend in the radial direction without being inclined.

(H05) In the previous embodiment, it is preferred to provide the small blade 23. However, the small blade 23 may be omitted.

(H06) In the previous embodiment, the upstream end paddle 23*e* and the small blade 23*f* have a plate shape to extend in the axial direction. However, the invention is not limited to such a configuration. For example, the upstream end paddle 23*e* and the small blade 23*f* may have a plate shape inclined in the axial direction or may include a plurality of plates.

(H07) In the previous embodiment, the developing devices Gy, Gm, Gc and Gk, in which the first stirring chamber 6 and the second stirring chamber 7 are obliquely disposed, are exemplified. However, the invention is not limited to such a configuration. For example, the invention can also be applied to a developing device in which the first stirring chamber 6 and the second stirring chamber 7 are disposed in a row in the horizontal direction or the gravitational direction.

(H08) In the previous embodiment, it is preferred that the rear end blade 23*d*1 of the first main carrying blade 23*d* is laid down on the first rotating shaft 22, as compared with the other blades. However, the invention is not limited to such a configuration. For example, the rear end blade 23*d*1 may have the same shape as those of other blades.

(H09) In the previous embodiment, a spiral blade is exemplified as the first main carrying blade 23*d*. However, the invention is not limited to such a configuration. For example, it may be possible to employ a configuration in which a plate having a semicircular shape is supported while being inclined with respect to the first rotating shaft 22.

(H10) Differently from the previous embodiment, the number of windings, the pitch and the like of the spiral blades 23*a* to 23*d* and 28*a* to 28*d* are not limited to the configuration exemplified in the previous embodiment. For example, they may be arbitrarily changed according to design, specifications and the like.

(H11) In the previous embodiment, it is preferred that the phases of the rear end 23*c*1 of the circulation carrying blade 23*c* and the front end 23*d*2 of the first main carrying blade 23*d* are synchronized, and the phases of the front end 23*c*2 of the circulation carrying blade 23*c* and the rear end 23*b*1 of the discard carrying blade 23*b* are synchronized. However, phases of any one of them or both of them may be deviated. In contrast, the phases of the rear end of the first supply carrying blade 23*a* and the front end of the discard carrying blade 23*b* may be synchronized.

(H12) In the previous embodiment, it is preferred that the gaps SP3 and SP4 are formed between the circulation carrying blade 23*c* and the first main carrying blade 23*d* and between the circulation carrying blade 23*c* and the discard carrying blade 23*b*, respectively. However, any one of them or both of them may be omitted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer holder that rotates while holding developers on a surface thereof;

a first chamber that contains the developers supplied to the developer holder;

a second chamber that contains the developers carried from the first chamber after being circulated between the first chamber and the second chamber;

a first inlet portion that connects the first chamber and the second chamber, and at least a part of the first inlet portion overlapping a developer-holding portion of the developer holder;

a second inlet portion that connects the first chamber and the second chamber;

a first carrying member that is disposed in the first chamber, and that carries the developers in the first chamber in a first carrying direction directed toward the second inlet portion;

a feeding blade that is provided at the upstream end portion of the first carrying direction of the first carrying member; and a second carrying member that is disposed in the second chamber, and that carries the developers in the second chamber in a second carrying direction directed toward the first inlet portion, wherein the first carrying member includes (i) a rotating shaft, (ii) a spiral blade provided at an outer periphery of the rotating shaft, and (iii) an auxiliary blade formed toward an upstream side of the first carrying direction from the spiral blade wall, a downstream end of the auxiliary blade being connected to the spiral blade, and a gap is formed between an upstream end of the auxiliary blade and the spiral blade wall in the first carrying direction; and a gap is formed between a downstream end of the feeding blade and the spiral blade wall in the first carrying direction.

2. The developing device according to claim 1, wherein the feeding blade feeds the developers to the developer holder, the developers being introduced to the first chamber from the first inlet portion, wherein the first carrying member is provided at a position overlapping a downstream-side end portion of the first inlet portion.

3. The developing device according to claim 1, wherein the feeding blade is provided at an outer periphery of the rotating shaft to extend in an axial direction, and the feeding blade has a plate shape.

4. The developing device according to claim 3, wherein an outer end of a radial direction of the feeding blade is inclined toward a direction separated from the rotating shaft as it is toward a direction of the upstream side from the downstream end of the first carrying direction.

5. The developing device according to claim 1, wherein the auxiliary blade has a rotation radius which is smaller than a rotation radius of the feeding blade.

6. The developing device according to claim 5,
wherein the auxiliary blade is provided at an outer periphery of the rotating shaft, and
the auxiliary blade has a plate shape which extends toward an upstream side of the first carrying direction of the spiral blade from an upstream end surface of the auxiliary blade.

7. The developing device according to claim 6,
wherein an outer end of a radius direction of the auxiliary blade is inclined toward a direction separated from the rotating shaft as it is toward a direction of a downstream side from the upstream end of the first carrying direction.

8. An image forming apparatus comprising:
a rotary image holder;
a latent image forming device that forms a latent image on a surface of the image holder;
a developing device according to claim 1, which develops the latent image on the surface of the image holder into a toner image;
a transfer device that transfers the toner image on the surface of the image holder to a medium; and
a fixing device that fixes the toner image on a surface of the medium.

9. The image forming apparatus according to claim 8, further comprising:
a feeding blade that is provided at the upstream end portion of the first carrying direction of the first carrying member, and that feeds the developers to the developer holder, the developers being introduced to the first chamber from the first inlet portion,
wherein the first carrying member is provided at a position overlapping a downstream-side end portion of the first inlet portion.

10. The image forming apparatus according to claim 8,
wherein the first carrying member includes the feeding blade provided at an outer periphery of the rotating shaft to extend in an axial direction, and
the feeding blade has a plate shape.

11. The image forming apparatus according to claim 10,
wherein a gap is formed between a downstream end of the feeding blade and spiral blade wall in the first carrying direction.

12. The image forming apparatus according to claim 10,
wherein an outer end of a radial direction of the feeding blade is inclined toward a direction separated from the rotating shaft as it is toward a direction of the upstream side from the downstream end of the first carrying direction.

13. The image forming apparatus according to claim 8,
wherein the auxiliary blade has a rotation radius which is smaller than a rotation radius of the feeding blade.

14. The image forming apparatus according to claim 13,
wherein the auxiliary blade is provided at an outer periphery of the rotating shaft, and
the auxiliary blade has a plate shape which extends toward an upstream side of the first carrying direction of the spiral blade from an upstream end surface of the auxiliary blade.

15. The image forming apparatus according to claim 14,
wherein an outer end of a radius direction of the auxiliary blade is inclined toward a direction separated from the rotating shaft as it is toward a direction of a downstream side from the upstream end of the first carrying direction.

16. The developing device according to claim 1, wherein the auxiliary blade is provided at a position overlapping the first inlet portion.

17. A developing device comprising:
a developer holder that rotates while holding developers on a surface thereof;
a first chamber that contains the developers supplied to the developer holder;
a second chamber that contains the developers carried from the first chamber after being circulated between the first chamber and the second chamber;
a first inlet portion that connects the first chamber and the second chamber, and at least a part of the first inlet portion overlapping a developer-holding portion of the developer holder;
a second inlet portion that connects the first chamber and the second chamber;
a first carrying member that is disposed in the first chamber, and that carries the developers in the first chamber in a first carrying direction directed toward the second inlet portion;
a feeding blade that is provided at the upstream end portion of the first carrying direction of the first carrying member; and
a second carrying member that is disposed in the second chamber, and that carries the developers in the second chamber in a second carrying direction directed toward the first inlet portion,
wherein the first carrying member includes (i) a rotating shaft, (ii) a spiral blade provided at an outer periphery of the rotating shaft, and (iii) an auxiliary blade formed toward an upstream side of the first carrying direction from the spiral blade wall at a position overlapping the first inlet portion, and
a gap is formed between an upstream end of the auxiliary blade and the spiral blade wall in the first carrying direction; and
a gap is formed between a downstream end of the feeding blade and the spiral blade wall in the first carrying direction.

* * * * *